United States Patent [19]

Schmitt

[11] Patent Number: 5,065,864

[45] Date of Patent: Nov. 19, 1991

[54] LAUNDRY VALET

[75] Inventor: Wayne I. Schmitt, Coventry, R.I.

[73] Assignee: American Tourister, Inc., Warren, R.I.

[21] Appl. No.: 630,831

[22] Filed: Dec. 20, 1990

[51] Int. Cl.[5] ..... A45C 3/00; A45C 13/00

[52] U.S. Cl. ..... 206/278; 206/287; 190/110; 383/23; 383/39

[58] Field of Search ..... 206/278, 287, 287.1; 383/23, 39; 190/110

[56] References Cited

U.S. PATENT DOCUMENTS

| | | | |
|---|---|---|---|
| 1,579,023 | 3/1926 | Myers | 383/39 X |
| 2,568,158 | 9/1951 | McWhorter | 206/287 |
| 2,974,780 | 3/1961 | O'Donovan | 206/278 |
| 3,139,133 | 6/1964 | Spector | 206/287.1 X |
| 3,294,134 | 12/1966 | Matross et al. | 206/287 X |
| 3,448,839 | 6/1969 | Lugash | 206/287 |
| 3,704,778 | 12/1972 | Raschdorf | 206/287 |
| 3,776,372 | 12/1973 | Lemelson | 206/287 |
| 3,834,497 | 9/1974 | Furst | 206/287 X |
| 3,929,224 | 12/1975 | Smith, Jr. | 206/287 |
| 4,580,667 | 4/1986 | Herwood | 190/110 |

FOREIGN PATENT DOCUMENTS

| | | | |
|---|---|---|---|
| 169373 | 11/1951 | Austria | 383/23 |
| 2097668 | 11/1982 | United Kingdom | 206/278 |

*Primary Examiner*—Sue A. Weaver

*Attorney, Agent, or Firm*—Wood, Herron & Evans

[57] ABSTRACT

A laundry valet which is foldable for storage and transport in a suitcase includes a triangular-shaped panel secured to one end along two legs of the triangle defining a pocket for receiving available coat hangers which may be slipped in with the hook portion of the coat hanger protruding out of the top at the vertex of the triangle thereby permitting the valet to be suspended in a closet or on a rack.

4 Claims, 1 Drawing Sheet

LAUNDRY VALET

This invention relates to a laundry valet and, more particularly, to a foldable laundry valet that accommodates any style hanger for convenient storing and handling in a closet or on a rack.

BACKGROUND OF THE INVENTION

Plastic or other water resistant bags and packs are known to the art for use in containing items for travel in a suitcase and then for hanging in a closet, bathroom, or on a rack upon the traveler's reaching his destination. Such bags or packs typically fold in a suitcase and are designed to contain items such as cosmetics and toiletries or soiled or wet clothes, towels, or other items. Such bags or packs typically are formed in whole or in part by a plastic, such as polyvinyl chloride, providing the pack with water resistance as well as visibility of the items contained therein.

In one form of overnight bag or pack, a hanger for the pack is formed integrally therewith. The hanger slides between layers of material forming the pack whereby it may be extended for hanging of the pack, for example, in a bathroom, and retracted for folding of the pack and storage in a suitcase.

SUMMARY OF THE INVENTION

The present invention relates to a laundry valet which is foldable for storage and transport in a suitcase and which accommodates any style hanger for convenient storing and handling in a closet, bathroom, or on a rack. In accordance with a presently preferred form of the invention, the laundry valet is constructed of a heavy duty polyvinyl chloride (PVC) which on one side is divided into two zippered compartments for containing the desired items. The valet further includes on the side opposite the two zippered compartments a triangular-shaped panel which is secured to the outside of the valet along two legs of the triangle. The triangular-shaped panel is not secured to the valet along its base or at the vertex of the triangle. The triangular-shaped panel thus forms in cooperation with one side of the laundry valet a pocket into which any of a wide variety of available coat hangers may be slipped with the hook portion of the coat hanger protruding out the top at the vertex of the triangle thereby permitting the valet to be suspended, for example, in a closet or on a rack.

In accordance with the present invention, the pocket is designed to receive many different types and styles of hangers including wire hangers, hangers typically found in motels and hotels, and hangers employed in garment bags. Accordingly, a high degree of flexibility is provided in the valet. However, when it is desired to fold the valet and pack it in a suitcase, the hanger may be easily removed and left behind such as in the case of standard wire, wood, or plastic hangers used in hotels and motels. If a garment bag hanger has been used, it likewise may be slid from the pocket and used in packing clothes in the garment bag.

DETAILED DESCRIPTION OF THE INVENTION

Figure 1:
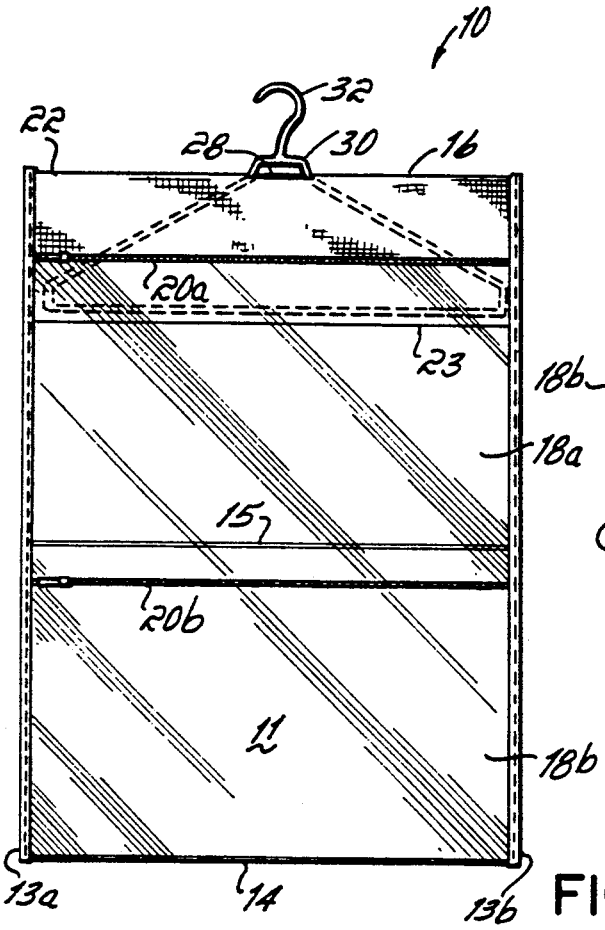
FIG. 1 is a plan view of the garment bag of the present invention with a coat hanger inserted therein permitting the valet to be suspended.
Figure 2:
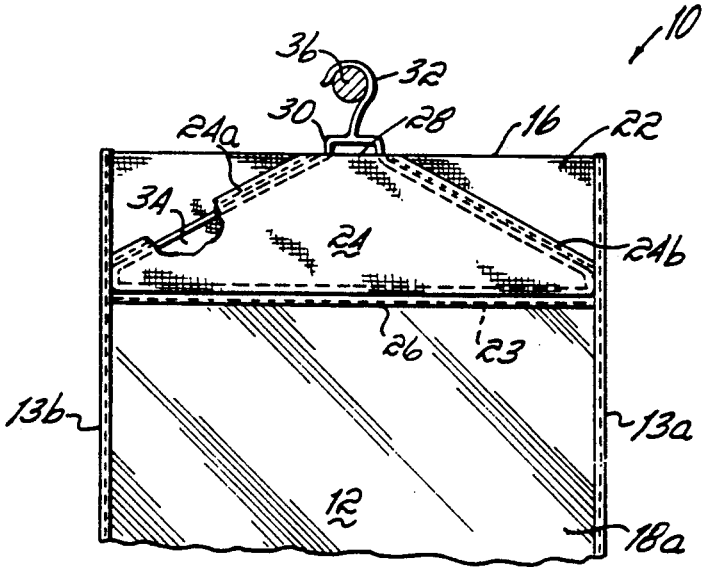
FIG. 2 is a back view of the top portion of FIG. 1.

Referring now to FIGS. 1 and 2, in a presently preferred form of the invention, the laundry valet 10 is formed of a pair of opposed sheets 11 and 12 of heavy duty polyvinyl chloride (PVC) The opposed sheets 11 and 12 may be conveniently provided by folding over a single PVC sheet along a bottom edge 14. A fabric such as nylon is provided extending down and around the sides 13*a*, 13*b* of the sheets 11, 12 through which stitching passes to join the sheets 11, 12 together, to close the side edges, and to provide a finished border. The PVC sheets are welded together along a line 15 generally intermediate the bottom edge 14 and top 16 to form two separate pockets 18*a*, 18*b*. Zippers 20*a*, 20*b* are provided permitting access to and closing of the pockets 18*a*, 18*b*, respectively, as desired.

On the one side of the valet 10 shown in FIG. 1, a fabric 22 such as nylon is stitched to the zipper 20*a* which in turn is welded to the PVC sheet 11. On the opposite side of the valet 10, as shown in FIG. 2, the fabric 22 is stitched to the PVC sheet 12 along a line 23.

On the side of the valet opposite the two pockets 18*a*, 18*b* (FIG. 2), a triangular-shaped panel 24 which may likewise be formed of a fabric such as nylon is sewn along two legs 24*a*, 24*b* thereof to the fabric 22. However, it is not secured to the fabric 22 along its base 26 nor is it secured to the valet 10 at the vertex 28 of the triangle opposite the base 26. Rather, the base 26 and vertex 28 are open permitting a standard coat hanger 30 to be inserted between the triangular panel 24 and the facing side of the fabric 22 whereby the hanger portion 32 of the coat hanger 30 protrudes out of the pocket 34 formed between fabric panels 22 and 24 permitting the valet 10 to be hung from a rack or rod 36 with the valet 10 being supported by the hanger 30 along the two secured edges 24*a*, 24*b* of the panel 24.

Figure 3:
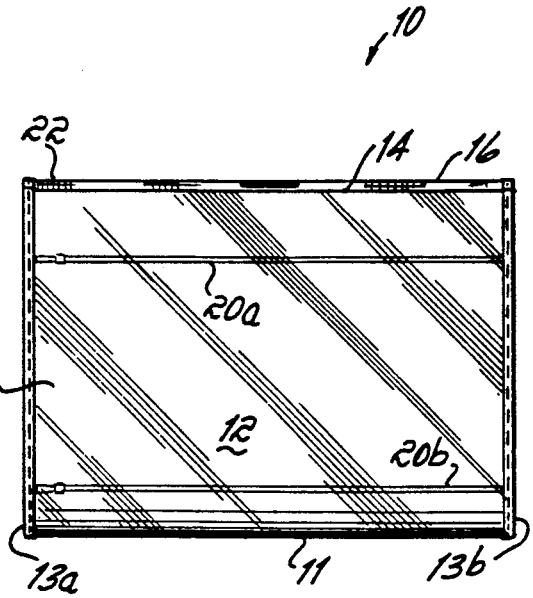
FIG. 3 is a plan view of the laundry valet with the coat hanger removed and the valet folded for placement in a suitcase.

When it is desired to pack the valet 10 in a suitcase, the coat hanger 30 and suspended valet 10 may be lifted from the rod 36, and the hanger 30 slid out of the pocket 34 through the open end 26. The valet 10 may then be folded in half, as shown in FIG. 3, for packing in a suitcase. The hanger may be left behind at the hotel or motel; or, if a garment bag hanger has been employed, that hanger may be used again for suspending clothing in the garment bag.

Thus having described the invention, what is claimed is:

1. A laundry valet capable of hanging from a variety of available coat hangers comprising:

a pair of generally rectangular-shaped plastic panels, said panels having ends and sides and being secured together along said sides and one of the respective ends to define a first pocket therebetween, at least one of said panels having an opening communicating with and providing access to said first pocket, a zipper extending along said opening for opening and closing said first pocket, said panels being foldable permitting said valet to be conveniently packed, a generally rectangular shaped fabric piece joined at one end of the valet to the other of the respective ends of said plastic panels, and a triangular-shaped fabric panel joined to one side of said rectangular shaped fabric piece substantially but not entirely along two legs thereof, said triangular-shaped panel being unsecured to said valet along its base thereby defining a second pocket for removably receiving a coat hanger therein, said second pocket being open at the bottom thereof along the unsecured leg of the triangular-shaped panel to receive said coat hanger therein and open at the top thereof permitting the hook portion of the coat hanger to protrude therefrom whereby said laundry valet may be suspended by said coat hanger removably received in said second pocket.

2. The laundry valet of claim 1 wherein said triangular-shaped fabric panel is secured to the side of said valet opposite said opening to said first pocket.

3. A laundry valet capable of hanging from a variety of available coat hangers comprising a sheet of plastic folded over upon itself defining a pair of opposed panels, said panels having ends and sides and being joined along said sides and along a line extending between said sides to define first and second pockets therebetween, first and second openings in said panels communicating respectively with said first and second pockets providing access to said first and second pockets, first and second zippers extending along said first and second openings, respectively, for opening and closing said first and second pockets, said plastic panels being transparent to permit viewing of the contents in said first and second pockets and said sheet of plastic being foldable permitting said valet to be conveniently packed, a generally rectangular-shaped panel joined to the ends of said pair of opposed panels, a triangular-shaped panel joined to one side of said rectangular-shaped panel substantially but not entirely along two legs thereof, said triangular-shaped panel being unsecured to said valet along its base thereby defining a third pocket for removably receiving a coat hanger therein, said third pocket being open at the bottom thereof along the unsecured leg of the triangular-shaped panel to receive said coat hanger therein and open at the top thereof permitting the hook portion of the coat hanger to protrude therefrom whereby said laundry valet may be suspended by said coat hanger removably received in said third pocket.

4. The laundry valet of claim 3 wherein said plastic sheet is a sheet of polyvinyl chloride folded upon itself.

* * * * *